United States Patent [19]

Tufte et al.

[11] Patent Number: 4,646,553

[45] Date of Patent: Mar. 3, 1987

[54] PRESS FOR CULTIVATOR SHANK

[76] Inventors: Jerold W. Tufte, Box 79; Leander O. Walen, R. R1, both of Glenfield, N. Dak. 58443

[21] Appl. No.: 725,377

[22] Filed: Apr. 22, 1985

[51] Int. Cl.[4] ..... B21D 7/05

[52] U.S. Cl. ..... 72/389; 72/386; 29/402.05; 29/148.3

[58] Field of Search ..... 72/380, 386, 389; 29/402.05, 402.19, 148.3

[56] References Cited

U.S. PATENT DOCUMENTS 630,484 8/1899 Brown ..... 72/389

3,344,635 10/1967 Van Allen ..... 72/389

FOREIGN PATENT DOCUMENTS 70926 4/1983 Japan ..... 72/389

*Primary Examiner*—Lowell A. Larson

*Assistant Examiner*—David B. Jones

*Attorney, Agent, or Firm*—Robert E. Kleve

[57] ABSTRACT

The invention comprises a hydraulic press for attachment to one of a plurality of shanks of an earth working implement. The press has a lateral base with a pair of spaced notches which form channels for the shank to be positioned in when the press is attached to the shank. A hydraulic cylinder has one end pivotally mounted to the frame of the press and its other end hydraulically actuates a piston which upon actuation telescopes the piston toward the shank intermediately between the spaced notches to engage the shank between the spaced notches, with the notches restraining outer portions of the shank against movement with the piston as it moves, while the piston moves against the intermediate portion and moves the intermediate portion thereby bending the shank. The press has a configuration to fit between the shanks of the implement when attached to the implement and said piston is adjustable on the frame so that when the press is attached to the shank the shank may remain mounted to the implement and an earth working tool may remain mounted to the shank while bending the shank at various locations along its length.

4 Claims, 6 Drawing Figures

PRESS FOR CULTIVATOR SHANK

This invention relates to straightening or correcting the bend of curvature of metal objects, more particularly, the invention relates to bending the shape of the shank of an earth working implement.

It is an object of the invention to provide a novel hydraulic press for correcting the bend in the shape of a cultivator shank while the shank remains mounted to the frame of a cultivator.

It is another object of the invention to provide a novel hydraulic press for attachment to the shank of an agricultural earth working implement and hydraulically actuatable to engage the shank to change or correct the curvature of the shank, while the shank remains mounted to its frame and an earth working tool remains mounted to the shank.

It is a further object of the invention to provide a novel press to curve the shank of an agricultural implement, such as a field cultivator or plow, back to its original curvature when it has become straightened from is original curvature from use.

It is a further object of the invention to provide a novel press device to curve the shank of an earth working implement in a manner to change the shape of the shank.

Further objects and advantages of the invention will become apparent as the description proceeds and when taken in conjunction with the accompanying drawings wherein;

FIG. 1 is a side elevational view of the hydraulic press device shown operatively attached to one of the shanks of a cultivator with the device having a hydraulic cylinder hydraulically actuating a piston wilh a roller thereon to engage the shank to curve the shank to a desired curvature while the shank remains mounted to its frame. Only one shank and a fragmentary showing of the frame is illustrated for brevity.

Briefly stated, the invention comprises a hydraulic press device for attachment to one of a plurality of spaced shanks of an agricultural implement, said press device being relatively narrow in one dimension to enable said press to be positioned in the space between the shanks while attached to the selected one shank, said device having a V shaped frame with spaced notches at the opposing outer ends of the legs of the frame forming and serving as channels for receiving the one shank in the notches or channels, a hydraulic cylinder is pivotally mounted at one end to the frame and has a telescoping piston at its other end hydraulically actuated with a round or roller like surface at its outer end to telescope out from said cylinder to cause the round surface of the piston to engage against the shank intermediate between the notches or channels, with the force of the engagement of the round surface against the shank causing the shank to curve or bend between the notches while the device is mounted to the shank and the shank is mounted to its frame, and with the piston being telescoped out further so that the force of the engagement continues until the shank has been curved to its desired shape at that location.

Figure 1:
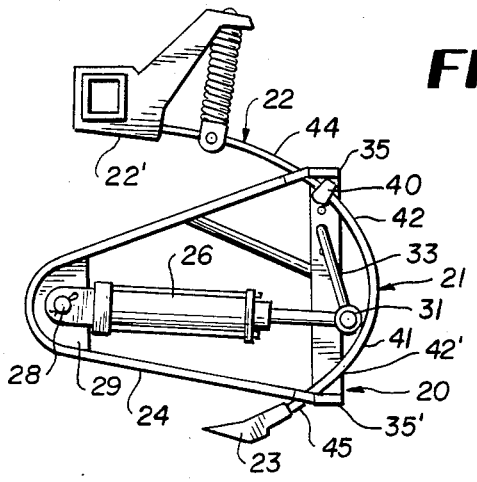

Referring more particularly to the drawings, in FIG. 1, the hydraulic press device 20 is shown operatively attached to the shank 21 of a conventional cultivator, with only a fragmentary showing of cultivator and only one of the shanks illustrated. The cultivator is of a conventional type having a plurality of curved shanks, spaced from one another, with their upper ends 22 being attached to the main frame 22' of the cultivator and with an earthworking tool or earth working shovel 23 attached to their lower ends.

The hydraulic press device 20 has a V shaped metal frame 24, with a base strap member 25 welded across the bottom of the frame. A hydraulic cylinder 26 has one end 26' pivotally mounted to the apex 26'' of the frame 24. The cylinder 26 has a pair of lugs 27 and 27' fixed thereto, with a pin 28 rotatably mounted in the lugs, and with the pin 28 being rotatably mounted in a bore 28' of plate 29. The plate 29 is fixed in the apex 26' of frame 24, to thereby rotatably mount the one end of the cylinder 26 to the frame.

The hydraulic cylinder 26 is of a conventional type having a piston 30, with a piston rod 30'. A roller or ring 31 is fixed to the outer end of the piston rod 30 for engagement with the shank 21.

The base plate 25 has a plurality of bores 32 at spaced intervals. A lever arm 33 has one end 34 pivotally mounted in a selected one of said bores 32 and held in place by a washer and cotter pin 34' extending through a bore in the end 34 of the lever arm. The lever arm 33 has its other end 34'' rotatably mounted in a center bore of roller or ring 31 and held in place by a spring washer, whereby the lever arm acts to position the piston in relation to the channels or notches 35 and 35' at the opposite edges of the press, so as to be closer or further away from one or the other of the notches, so that the piston upon actuation is selectively nearer the shank portion at one or the other notch or channel.

The notches or channels 35 and 35'' are formed by the metal base strap member 25 having laterally bent ends 36 and 36' which have short rods 37 and 37' welded to the outermost ends of the ends 36 and 36', and which project laterally away from the ends 36 and 36' to form the notches or channels.

OPERATION

Figure 2:
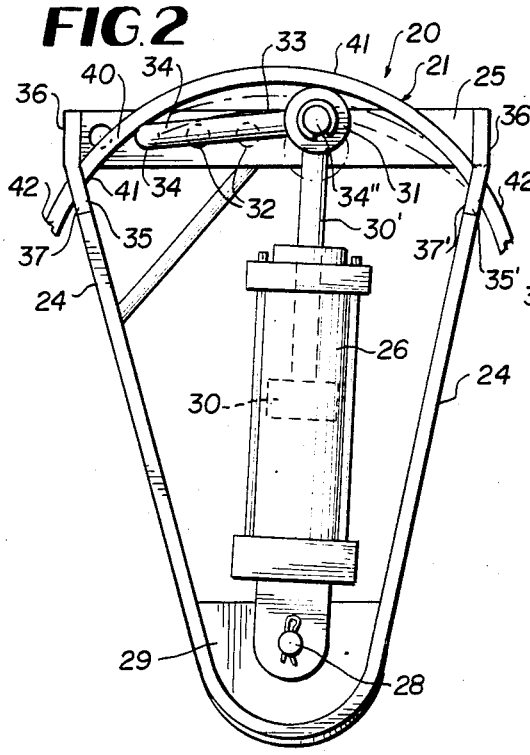
FIG. 2 is an enlarged front side elevational view of the hydraulic press device shown operatively attached to the shank of a cultivator.
Figure 3:
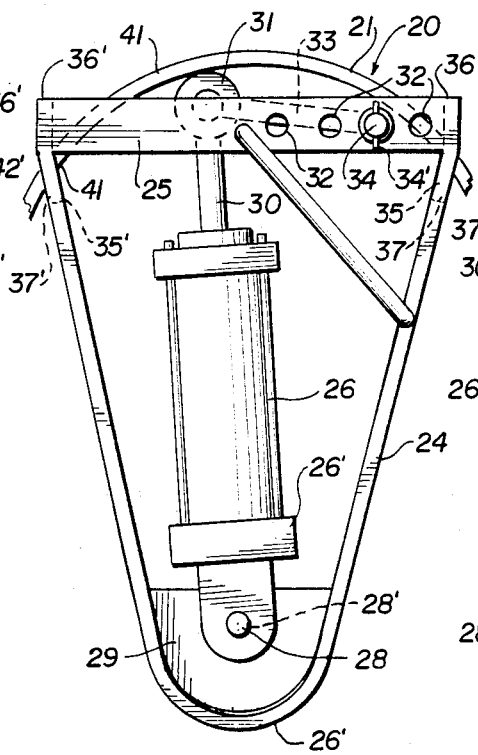
FIG. 3 is an enlarged rear side elevational view of the hydraulic press device shown operatively attached to the shank.

When one of the shanks 21 of a field cultivator or plow has become too straight from use, so that it is desirable to curve the shank back to its original curvature, the device 20 will be attached to the shank 21, by sliding the notched or channeled ends 35 and 35' over the shank at a desired location so that the shank rests in the confines of the channels, such as illustrated in FIGS. 1 and 2. Since the curvature of the shank may cause the press to slide down the shank in the channels, if not held in place, a conventional vise or clamp may be mounted to the shank 21 and fixed there by clamping at a location 40 below the channel portion 35, to lock onto the shank at that location and engage against the end 35 to prevent the press from sliding down on the shank. The press as an alternative may be held in place on the shank as illustrated, manually, until the hydraulic cylinder 26 has been actuated to project the piston and its roller, ring or round surface to move the round surface against the shank with sufficient frictional engagement, so that the frictional engagement of the round surface 31 against the shank on one side, and the friction of the spaced lateral ends 36 and 36' of the base member against the shank on the opposite side is sufficient to hold the device in place on the shank.

Whereupon, the operator will further activate the hydraulic cylinder, once the device is held in place, to project the piston and its round surface 31 against the shank sufficiently far to bend the intermediate portion 41 of the shank. The channels formed by the ends 36 and 36' will restrain the outer portions 42 and 42' of the shank, adjacent the notches 35 and 35', from moving with the piston and its round surface upon activation, when the round surface of the piston engages the intermediate portion of the shank, however, the intermediate portion 41 is free to move with the piston under the force of the piston and the action of the piston thereby bends the intermediate portion of the shank relative to the outer spaced portions 42 and 42'. The hydraulic cylinder will be continued to be activated until the shank has been bent sufficiently as desired at that particular location.

Whereupon, while manually holding the device or with the use of a clamp or vise still in place on the shank, the cylinder will be activated in the opposite direction to move the round surface 31 away from the shank.

Whereupon, the clamp or vise member may be moved to another location on the shank so that the device may be slid up against the vise or clamp at another location and held in place at another location where it is desired to curve the shank. The hydraulic cylinder will again be activated to project the piston and its round surface toward and against the shank at its new location to bend or curve the shank until a desired bend or curvature has been formed at that location. The process will be repeated at such other locations until the original curvature or the desired curvature of the shank has been accomplished.

The lever arm 33 serves as a crank to cause the piston and its round surface to pivot upward and downward toward the shank about the pivotal axes of the crank or lever arm. This will be at different locations between the notches or channels 35 and 35', the location depending upon which of the bores 32 the other end 34 of the crank has been mounted into.

When it is desired to bend the shank at a location near the end 45 the shank where the shovel 23 is attached to the shank, without having to remove the shovel, such as illustrated in FIG. 1, it may be desirable to remove the press and adjust the crank or lever arm moving the pin 34 to one of the bores 32 closer to notch 35' so that the roller will engage the shank at a location nearer the notch 35', and then reattach the press to the shank in the same manner as illustrated and in the same location as illustrated. This will enable the operator to bend the shank at a location near the end 45, without having to remove the shovel from the shank, as is illustrated in FIG. 1.

Conversely, when it is desired to bend the shank at a location near the end 44, where the shank is attached to the main frame 22 reverse the press about an axis of 180 degrees passing through the apex and base 25 of the press, and reattach it with to the shank near the end 44 with the notch 35' now closest to the end 44. Prior to reattaching it the pin 34' may be adjusted to place the roller the desired distance from notch 35' so that the press when reattached to the shank will engage the shank at the desired distance from the main frame. This enables the operator to bend the shank near the end 44 of the shank by attaching and operating the press without having to remove the shank from the main frame. Thus the press can be attached to the shank at any location between the ends 44 and 45 of the shank, and bend the shank at various locations, and can bend the shank near the ends by the adjustment just described. A handle 46 is attached to the frame 24 for carrying.

Figure 4:
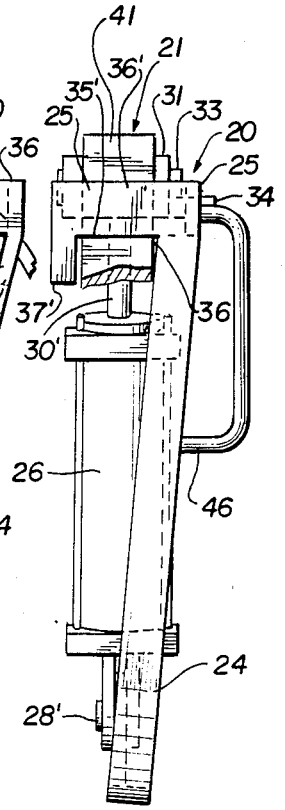
FIG. 4 is an end view of the hydaulic press shown operatively attached to a cultivator shank.
Figure 5:
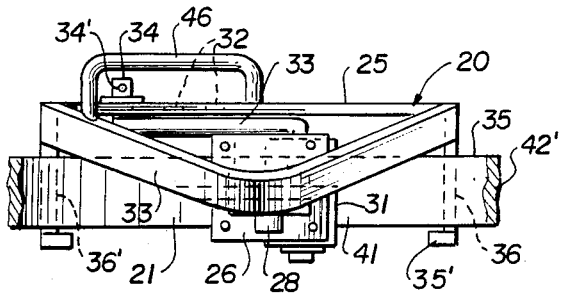
FIG. 5 is a top plan view of the hydraulic press shown operatively attached to a cultivator shank.
Figure 6:
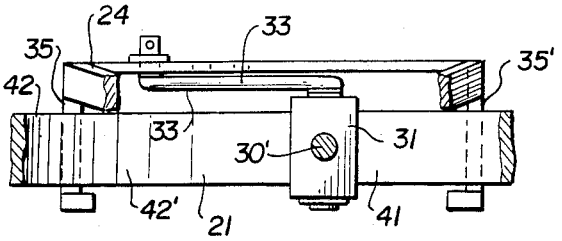
FIG. 6 is a cutaway top view along line 6—6 of FIG. 2.

The press device has a sufficiently narrow dimension when viewed from FIG. 4, so that it wil fit freely between the shanks of a cultivator or plow, when attached to one of the shanks whether it is in its position illustrated in FIG. 1 or reversed 180 degrees, so that the press can be operated to bend one of the shanks without having to remove an adjacent shank. The device can be used for conventional cultivators, chisel plows and the like.

The device operates to bend or curve the shank of a field cultivator or chiseld plow where the shanks have some flexibility, being made of spring steel, and which may become straightened out to some extent or deformed from their original shape, after use, and the device bends the shank to change the curvature back to its original shape. FIG. 2 illustrates as an example the shank and outer end of the piston in dashed lines before the cylinder has been activated to project the piston for bending, and in solid lines after the piston has been projected and the shank has been bent by the movement of the piston.

The rods 37 and 37' of the notches are positioned at an angle toward one another slightly to be more perpendicular to the shank throughout its movement in being bent, so as to better retain the shank in the notches.

It will be obvious that various changes and departures may be made to the invention without departing from the spirit and scope thereof, and accordingly, it is not intended that the invention be limited to that specifically described in the specification or as illustrated in the drawings but only as set forth in the appended claims wherein

What is claimed is:

1. A press for a cultivator shank of a cultivator with one end of the shank mounted to a cultivator frame and the other end having an earthworking tool mounted thereon, said press comprising a frame, a fluid actuated piston and cylinder, said frame having a pivotal mounting at one portion of the frame for pivotally mounting one end of the piston and cylinder thereto, said frame having a pair of spaced notches spaced laterally from one another and spaced longitudinally from the pivotal mounting, said fluid actuated cylinder being actuatable to telescopically move said piston relative to said cylinder to move the other end of the piston and cylinder toward the notches along a path intermediate between the notches whereby the notches may receive and hold a portion of the shank and the other end of the piston and cylinder may engage said portion of the shank at a location intermediate between the notches to bend the shank for restoring the curvature in said shank, guideway means having one portion mounted to said frame and the other portion movably mounted in relation to the other end of said piston and cylinder to guide the other end of said piston and cylinder so that the movement of the other end of the piston and cylinder is maintained along a defined path longitudinally toward the location between the notches, adjustment means to adjust the guideway means laterally toward one or the other of said notches to laterally adjust the path of the other end of the piston and cylinder to a path that is nearer one or the other of said notches.

2. A press according to claim 1 wherein said movable mounting of said guideway means comprises a pivotal mounting.

3. A press according to claim 2 wherein one end of said piston telescopes out an end of said cylinder, and the other end of said piston is said other end of said piston and cylinder for said pivotal mounting to said guideway means and the other end of the cylinder is said one end of said piston and cylinder for pivotal mounting to said frame.

4. A press for a cultivator shank of a cultivator with one end of the shank mounted to a cultivator frame and the other end having an earthworking tool mounted thereon, said press comprising a frame, a fluid actuated piston and cylinder, said frame having a pivotal mounting at one portion of the frame for pivotally mounting one end of the piston and cylinder thereto, said frame having a pair of spaced notches spaced laterally from one another and spaced longitudinally from the pivotal mounting, said fluid actuated cylinder being actuatable to telescopically move said piston relative to said cylinder to move the other end of the piston and cylinder toward the notches along a longitudinal path intermediate between the notches whereby the notches may receive and hold a portion of the shank and the other end of the piston and cylinder may engage said portion of the shank at a location intermediate between the notches to bend the shank for restoring the curvature in said shank, guideway means comprising a lever having one end pivotally mounted to said frame and the other end pivotally mounted to the other end of the piston and cylinder to guide the other end of the piston and cylinder so that the movement of the other end of the piston and cylinder is maintained along a defined path longitudinally toward the location between the notches, adjustment means to adjust the guideway means at its one portion laterally toward one or the other of the notches laterally adjust the path of the other end of the piston and cylinder to a path that is nearer one or the other of said notches.

* * * * *